US006314590B1

(12) United States Patent
Lee

(10) Patent No.: US 6,314,590 B1
(45) Date of Patent: Nov. 13, 2001

(54) DRAINAGE DEVICE

(76) Inventor: Kok Wing Lee, 9 Casuarina Walk, Singapore 574069 (SG)

( * ) Notice: Subject to any disclaimer, the term of this patent is extended or adjusted under 35 U.S.C. 154(b) by 0 days.

(21) Appl. No.: 09/673,711

(22) PCT Filed: Apr. 16, 1999

(86) PCT No.: PCT/SG99/00032

§ 371 Date: Oct. 20, 2000

§ 102(e) Date: Oct. 20, 2000

(87) PCT Pub. No.: WO99/54560

PCT Pub. Date: Oct. 28, 1999

(30) Foreign Application Priority Data

Apr. 21, 1998 (SG) ..... 9800770
Aug. 21, 1998 (SG) ..... 9803180

(51) Int. Cl.[7] ..... E03C 1/28; E03F 5/04

(52) U.S. Cl. ..... 4/286; 4/287; 4/597; 4/665; 137/362

(58) Field of Search ..... 4/286–289, 293–295, 4/665, 597, 605; 137/362, 872

(56) References Cited

U.S. PATENT DOCUMENTS 97,219 * 11/1869 Nott ..... 4/288
346,579 * 8/1886 Butler ..... 4/287
695,312 * 3/1902 Hickey ..... 137/872
4,103,372 8/1978 Cuschera ..... 4/286
5,353,448 * 10/1994 Lee ..... 4/597

FOREIGN PATENT DOCUMENTS

151278-B1 * 12/1931 (CH) ..... 4/295
9012123 12/1990 (DE) .

* cited by examiner

*Primary Examiner*—Charles R. Eloshway
(74) *Attorney, Agent, or Firm*—Ostrolenk, Faber, Gerb & Soffen, LLP

(57) ABSTRACT

A drainage device (1) for a waste water outlet (12) includes an outer tubular member (102) adapted to fit within the waste water outlet (12). An inner tubular member (103) is located within the outer tubular member (102). The interior of the inner tubular member (103) provides a first outlet and a second outlet is defined by the external wall of the inner tubular member (103) and the internal wall of the outer tubular member (102). A valve member (108, 109) is movably mounted with respect to the inner and outer tubular members (102, 103) for movement between a first position in which the second outlet is obturated and the first outlet is open to permit a liquid to flow therethrough, and a second position in which the second outlet is open to permit liquid to enter the second outlet.

11 Claims, 3 Drawing Sheets

DRAINAGE DEVICE

The invention relates to a drainage device and in particular a drainage device for a waste water outlet in a shower, bath or sink.

In accordance with the present invention, a drainage device for a waste water outlet comprises an outer tubular member adapted to fit within the waste water outlet, an inner tubular member located within the outer tubular member, the interior of the inner tubular member providing a first outlet and a second outlet being defined by the external wall of the inner tubular member and the internal wall of the outer tubular member, and a valve member movably mounted with respect to the inner and outer tubular members for movement between a first position in which the second outlet is obturated and the first outlet is open to permit a liquid to flow therethrough, and a second position in which the second outlet is open to permit liquid to enter the second outlet.

Preferably, the valve mechanism is slidably mounted on the inner or the outer tubular member and is preferably slidably mounted within the inner tubular member.

Typically, the valve mechanism comprises a flange which obturates the second outlet when the valve mechanism is in the first position, and is raised away from the second outlet to permit liquid to enter the second outlet when the valve mechanism is in the second position.

Typically, the valve mechanism may comprise a tubular member through which liquid may flow into the inner tubular member.

Preferably, the valve mechanism comprises a filter device to prevent or minimise the possibility of solid objects entering the first outlet. Typically, solid material is trapped in or on the filter device.

Preferably, the valve mechanism is biased to the second position and may be moved to the first position by a force applied to the valve mechanism to move the valve mechanism from the second to the first position.

Preferably, the inner tubular member is located concentrically within the outer tubular member. Typically, the outer tubular member, the inner tubular member and the valve mechanism are all concentric.

Typically, the inner tubular member is adapted to be coupled to a drain pipe which leads to a drainage or sewerage system and the outer tubular member is adapted to be coupled to a waste water tank so that water entering the second outlet flows between the inner and outer tubular members and into the tank.

Where the drainage device is installed in a waste water outlet of a sink, bath or shower, the waste water from the waste water tank may subsequently be used as a water supply for a cistern for flushing a toilet.

An example of a drainage device in accordance with the invention will now be described with reference to the accompanying drawings, in which.

Figure 1:
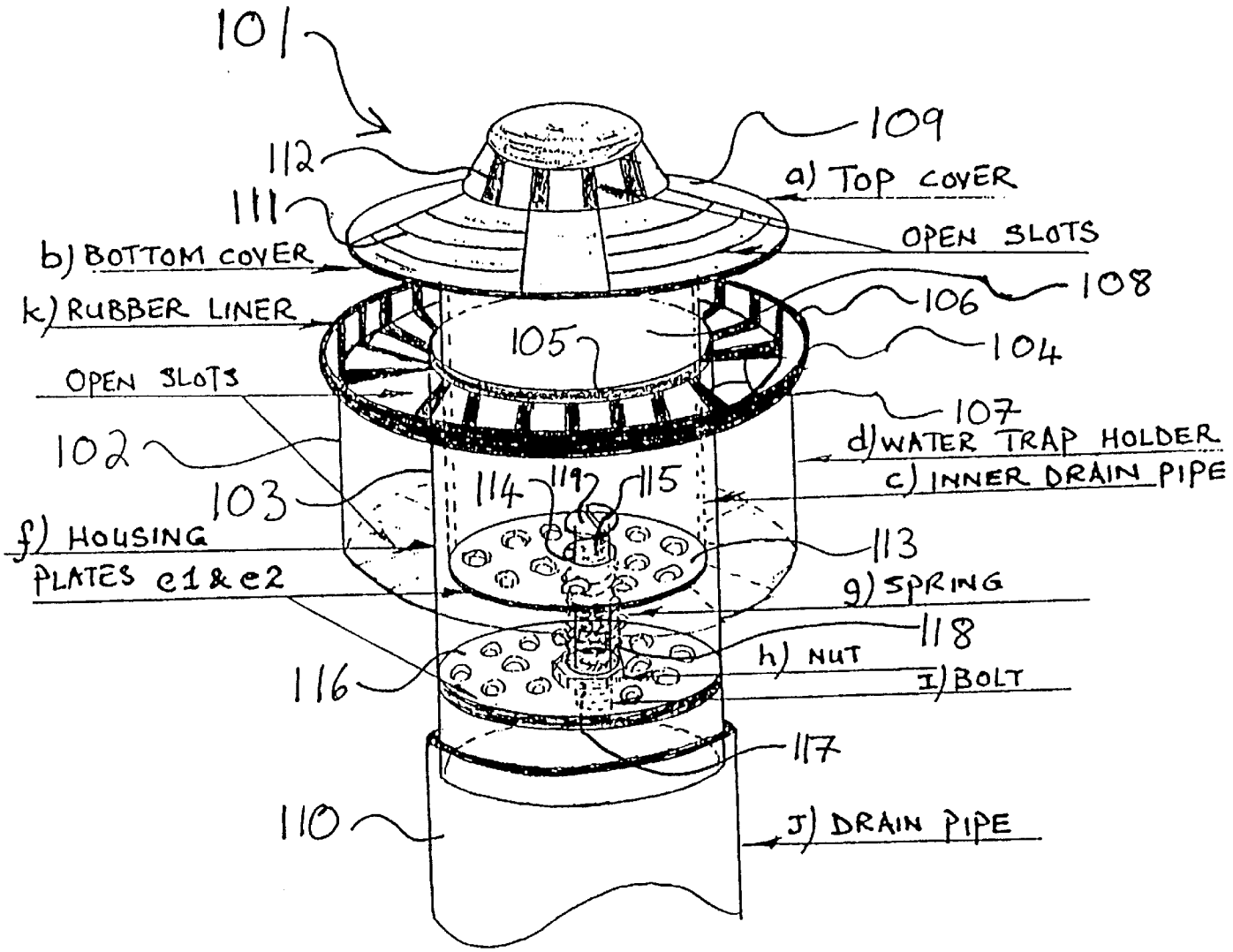
FIG. 1 is a schematic view showing a drainage device.

FIG. 1 shows a drainage device which may be installed in an outlet in a bath or sink or shower tray. The drainage device 101 includes an outer housing 102 in the form of a tubular pipe and an inner pipe 103 concentrically mounted within the outer housing 102 by means of a rubber support 104. The support 4 has an inner rim 105, an outer rim 106 and support members 107 extending between the rims 105, 106. The outer rim 106 engages with and is fixed to the top edge of the housing 102 and the inner rim 105 engages with and is fixed to the top edge of the inner pipe 103. The lower end of the inner pipe 103 is dimension to permit it to be connected to a conventional drain pipe 110.

Figure 3:
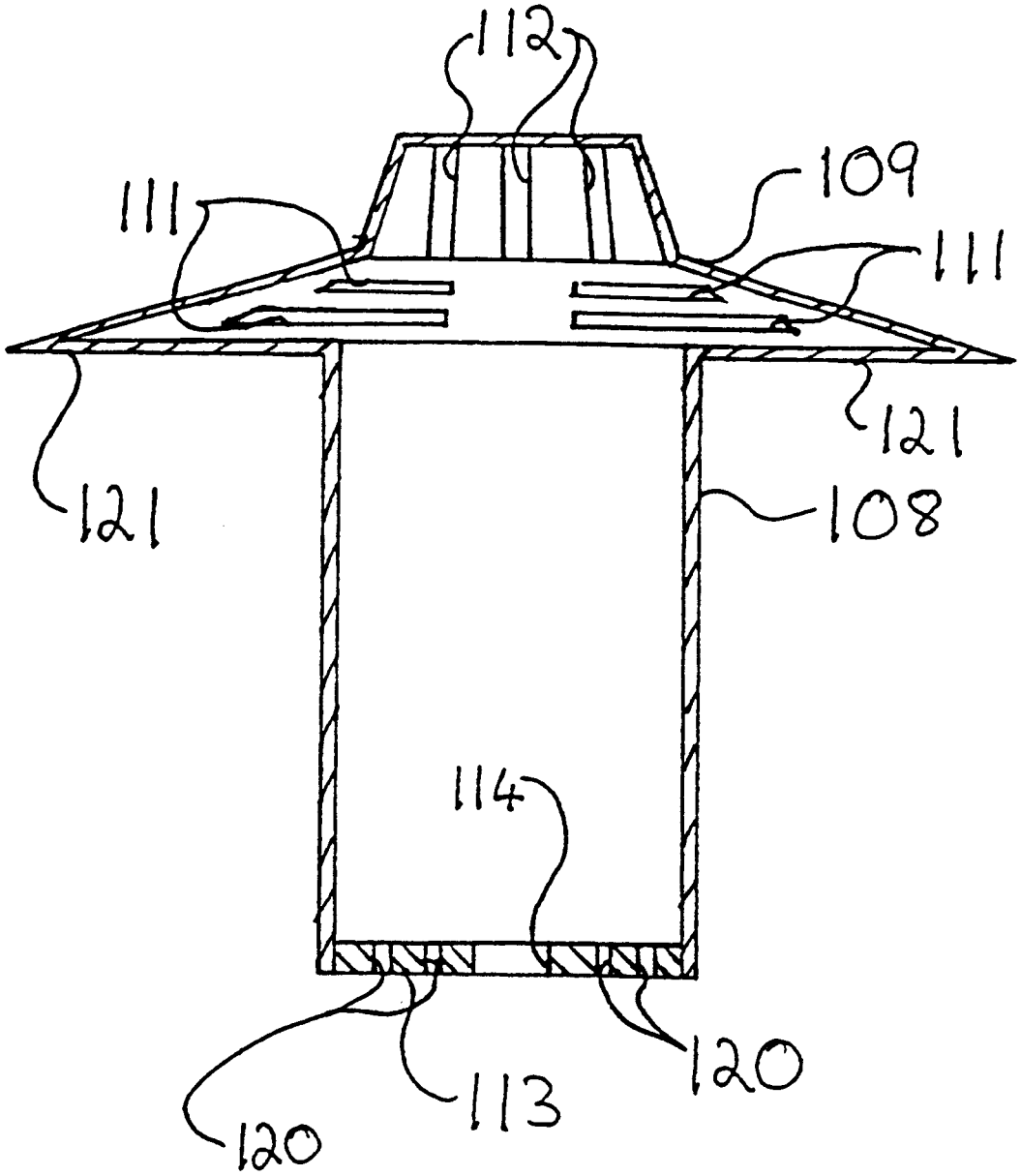

Located within the inner pipe 103 is a central pipe 108 with a top cover 109 (see also FIG. 3) which has a number of slots 111, 112 which permit water to enter the central pipe 108. The slots are dimensioned such that water can pass through the slots but solid material is prevented from passing through the slots 111, 112 and gathers on the top surface of the cover 109.

The lower end of the central pipe 108 has a perforated plate 113 with perforations 120 and a central aperture 114 through which a bolt 115 extends. The bolt 115 has a head 119 which fits through the aperture 114. The bolt 115 also extends through a second plate 116 fixed within the inner pipe 103 and is retained by a nut 117 on the opposite side of the plate 116 from the plate 113. A helical spring 118 is located between the plates 116 and 113 to bias the central pipe 108 and top cover 109 away from the support 104 so that the plate 113 butts against the head 119 of the bolt 115 and the top cover 109 is raised above the support 104, as shown in FIG. 1. As the bolt head 119 which fits through the aperture 114, the central pipe 108 and top cover 109 may be removed from the inner pipe 103 for cleaning.

By applying downwards pressure to the top cover 109, the top cover 109 and central pipe 108 move downwards to compress the spring 18 and move the plate 113 towards the plate 116. When the top cover 109 and central pipe are pushed fully downwards, underside 121 of the top cover 109 obturates the slots between the support members 107 so that water is prevented from flowing through the slots 107. When the slots 107 are obturated, water flows through the slots 111, 112 in the top cover 109 and through the central pipe 108 and plate 113 into the inner pipe 103 and exits the inner pipe 103 through the perforated plate 116 into the drain pipe 110.

In use, the drainage device 101 is installed in an outlet of a sink, bath or shower tray such that the top edge of the support ring 104 is flush with the surface of the sink, bath or shower tray adjacent to the outlet.

Figure 2:
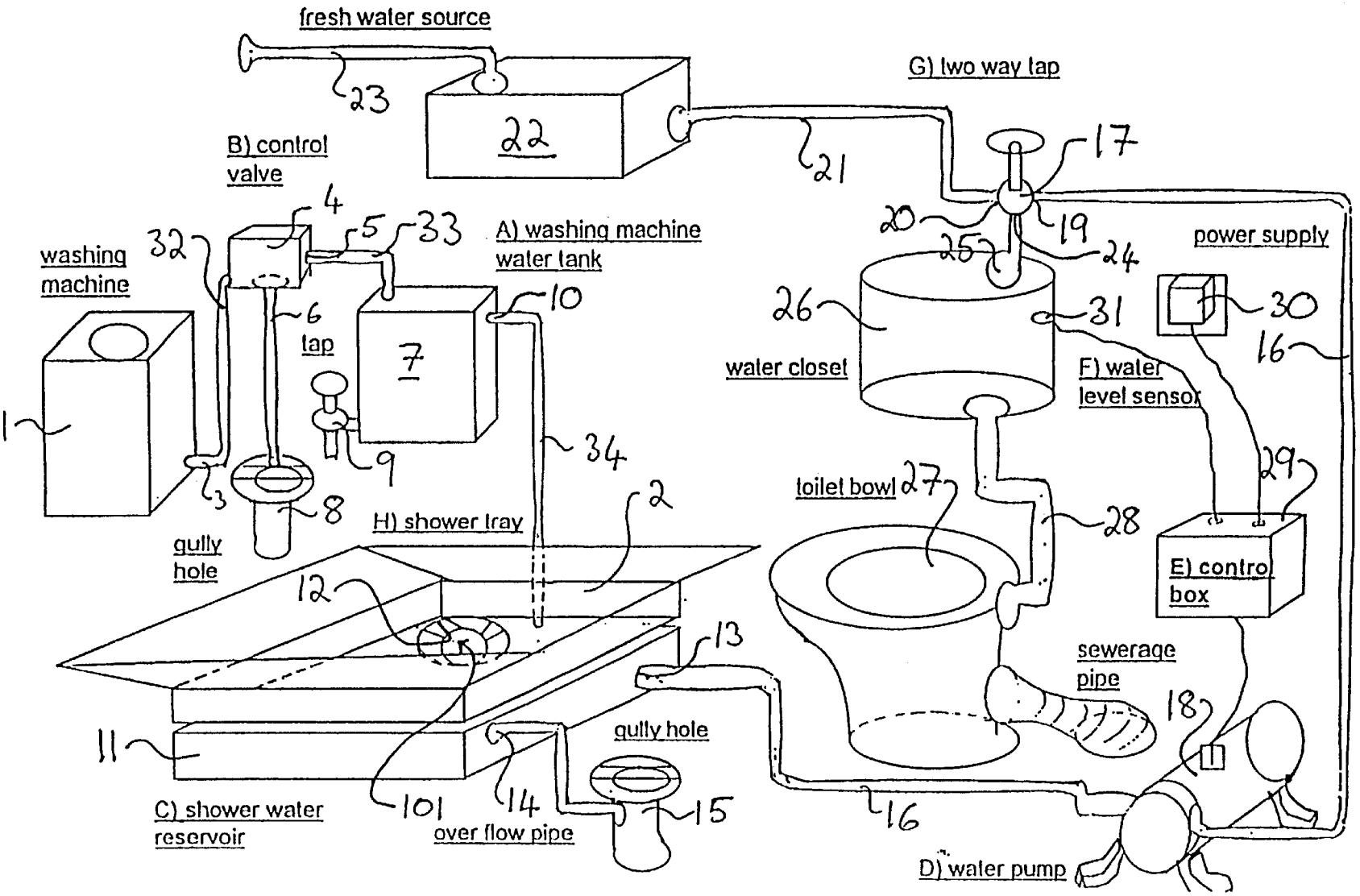
FIG. 2 is a diagram showing a system for reusing waste water incorporating the drainage device; and, FIG. 3 is a cross-sectional view of a central pipe and top cover forming part of the drainage device.

FIG. 2 shows an example of a system for reusing waste water in which the drainage device 101 can be used. In this example, the device 101 is installed in a waste water outlet 12 from a shower tray 2.

FIG. 2 shows two water consuming appliances: a washing machine 1; and a shower tray 2 which forms part of a shower. An outlet 3 from the washing machine 1 is connected to a water pipe 32 which is connected to an inlet of a control valve 4 which has two outlets 5, 6. The outlet 5 is connected to a water pipe 33 which connects the control valve 4 to a used water tank 7 and the outlet 6 is coupled to a drain 8.

The used water tank 7 includes a manually operated tap 9 which permits water to be drawn from the tank 7, for example, into a container such as a bucket. The tank 7 also has an outlet 10 which is connected by a water pipe 34 to a second used water tank 11 located below the shower tray 2. The shower tray 2 has a waste water outlet 12 which is connected to the second used water tank 11 and permits water to flow from the shower tray 2 into the used water tank 11.

The used water tank 11 has an outlet 13 and an overflow 14 which is connected to a drain 15. The outlet 13 is connected by a water pipe 16 to a two way valve 17 via a water pump 18. The water pipe 16 is coupled to a first inlet 19 of the valve 17 and a second inlet 20 is coupled by a water pipe 21 to a cold water tank 22 which is filled by a water pipe 23 connected to a fresh (or unused) water source. The valve 17 also has an outlet 24 which is coupled by a water pipe 25 into a cistern 26 which is used to store water for flushing a toilet 27. The water for flushing the toilet 27 passes from the cistern 26 to the toilet 27 via a conduit 28.

A control box 29 is powered by a mains power supply 30 and is connected to a water level sensor 31 in the cistern 26, and to the water pump 18.

The valve 17 may be manually operable to connect the first inlet 19 or the second inlet 20 to the outlet 24. Alternatively, the valve 17 may be operable automatically under control of the control box 29. For example, the valve 17 may be an electromechanical valve which is controlled by the control box 29 and the control box 29 is coupled to the pump to detect whether the pump is pumping water when it is operated. If the control box 29 detects that there is no water to be pumped through the pipe 16 when the water pump 18 is operating, then the control box 29 switches off the water pump 18 and switches the valve 17 so that the second inlet 20 is coupled to the outlet 24.

In use, during the washing cycle of the washing machine 1, waste water flows from the outlet 3 of the washing machine 1 to the control valve 4 through the conduit 32. If the water from the washing machine is from the first portion of the washing cycle, then the control valve 4 is operated to discharge the used water through the outlet 6 to the drain 8. However, for a subsequent portions of the cycle, when the water exiting the outlet 3 is cleaner, the control valve 4 switches to pass the water to the outlet 5 and into the used water tank 7 through the pipe 33.

Water may then be drawn from the used water tank 7 by means of the tap 9 into to a container, such as a bucket. Alternatively, the water from the water tank 7 is passed out by the pipe 34 to the used water tank 11. The used water tank 11 collects used water from the washing machine 1 via the tank 7 and from the shower tray 2 via the drain 12. Used water is then stored in the used water tank 11 and any excess water is discharged from the tank 11 through the overflow outlet 14 and into the drain 15.

When the toilet 27 is flushed, water from the cistern 26 passes through the pipe 28 to the toilet 27 and the cistern 26 empties of water. The control box 29 detects a drop in the water level in the cistern 26 by means of the water level sensor 31 and switches on the water pump 18 to pump water from the used water tank 11 through the pipe 16 to the valve 17. If the control box 29 detects water being pumped by the pump 18, the valve 17 is actuated such that the first inlet 19 is switched to the outlet 25. Hence, water from the pipe 16 passes through the valve 17 out of the outlet 24 and into the pipe 25 to fill the cistern 26. When the cistern 26 has sufficient water in it, the control box 29 detects this via the water level sensor 31 and switches off the pump 18.

If the control box 29 detects that the pump is not pumping water when it is switched on, this indicates that there is no water in the tank 11 and the control box 29 switches off the pump 18 and switches the valve 17 so that the second inlet 20 is connected to the outlet 24. Hence, water from the cold water tank 22 passes through the pipe 21, the valve 17 and pipe 25 into the cistern 26 to fill the cistern 26.

As an alternative to having the valve mechanism 17, it is possible that the pipe 21 and the pipe 16 may discharge water directly into the cistern 26. In such a mechanism, the pipe 21 would have a valve operated by conventional float type valve in the cistern 26 and when toilet 27 is flushed, a mixture of waste water from the tank 11 and clean water from the cold water tank 22 would fill the cistern 26. In this alternative example, preferably, the amount of water filling the cistern 26 from the pipe 16 would be greater than the amount of water filling the cistern 26 from the pipe 21.

The end of the inner pipe 103 adjacent to the perforated plate 116 is connected to the waste water drain pipe 110. The lower end of the outer housing 102 is coupled to an inlet of the used water tank 11 which encircles the lower end of the inner pipe 103 and the upper end of the drain pipe 110.

Hence, if the central pipe 108 and top cover 109 are in the position shown in FIG. 1, water from the shower tray 2 flows through the slots between the support members 107 and between the annulus defined by the outer surface of the inner pipe 103 and the inner surface of the housing 102 and into the waste water tank 11 for storage and reuse (in this example) as water for flushing the toilet 27. However, if the central pipe 108 and top cover 109 are pressed downwards, the underside 121 of the top cover 109 obturates the apertures between the support members 107 and water from the shower tray 2 must flow through the slots 111, 112 into the central pipe 108 and through the inner pipe 103 into the waste water drain pipe 110.

Therefore, the invention permits a user to select whether water in a sink, bath or shower tray is to be reused. If a user decides that the water is too dirty to reuse, the user presses the top cover 109 downwards (for example, by using a hand or foot to apply a downward force to the top cover 109) so that the water in the sink, bath or shower tray drains into the waste water drain pipe 110. Alternatively, if the water is sufficiently clean to be reused, the user can remove the force from the top cover 109 to permit the top cover 109 and central pipe 108 to move to the position shown in FIG. 1 and water is permitted to enter the annular space between the outer surface of the inner pipe 103 and the inner surface of the housing 102 to flow into a waste water tank for reuse.

What is claimed is:

1. A drainage device for a waste water outlet comprising an outer tubular member adapted to fit within the waste water outlet, an inner tubular member located within the outer tubular member, the interior of the inner tubular member providing a first outlet and a second outlet being defined by the external wall of the inner tubular member and the internal wall of the outer tubular member, and a valve member movably mounted with respect to the inner and outer tubular members for movement between a first position in which the second outlet is obturated and the first outlet is open to permit a liquid to flow therethrough, and a second position in which the second outlet is open to permit liquid to enter the second outlet.

2. A drainage device according to claim 1, wherein the valve mechanism is slidably mounted on the inner or the outer tubular member.

3. A drainage device according to claim 2, wherein the valve mechanism is slidably mounted within the inner tubular member.

4. A drainage device according to claim 1, wherein the valve mechanism comprises a flange which obturates the second outlet when the valve mechanism is in the first position, and is spaced from the second outlet to permit liquid to enter the second outlet when the valve mechanism is in the second position.

5. A drainage device according to claim 1, wherein the valve mechanism comprises a third tubular member.

6. A drainage device according to claim 5, wherein the valve mechanism comprises apertures to permit water to enter the third tubular member and flow through the third tubular member to the first outlet.

7. A drainage device according to claim 6, wherein the valve mechanism comprises a filter device at the apertures.

8. A drainage device according to claim 7, wherein the filter device is provided by the shape and configuration of the apertures.

9. A drainage device according to claim 1, wherein the valve mechanism is biased to the second position and may be moved to the first position by a force applied to the valve mechanism to move the valve mechanism from the second to the first position.

10. A drainage device according to claim 1, wherein the drainage device is adapted to be mounted in a waste water outlet in a shower, bath or sink.

11. A shower tray comprising a drainage device in accordance with claim 1.

* * * * *